US012421664B2

(12) United States Patent
Kambara et al.

(10) Patent No.: US 12,421,664 B2
(45) **Date of Patent: *Sep. 23, 2025**

(54) PAPERMAKING AGENT, MANUFACTURING METHOD FOR PAPERMAKING AGENT AND PAPER

(71) Applicant: ARAKAWA CHEMICAL INDUSTRIES, LTD., Osaka (JP)

(72) Inventors: Ryusuke Kambara, Osaka (JP); Hiroyuki Ioka, Osaka (JP); Shuichi Takaki, Osaka (JP)

(73) Assignee: ARAKAWA CHEMICAL INDUSTRIES, LTD., Osaka (JP)

( * ) Notice: Subject to any disclaimer, the term of this patent is extended or adjusted under 35 U.S.C. 154(b) by 184 days.

This patent is subject to a terminal disclaimer.

(21) Appl. No.: 17/945,097

(22) Filed: Sep. 15, 2022

(65) Prior Publication Data

US 2023/0085796 A1 Mar. 23, 2023

(30) Foreign Application Priority Data

Sep. 17, 2021 (JP) ..... 2021-152558

(51) Int. Cl.
*D21H 17/37* (2006.01)
*D21H 17/28* (2006.01)
*D21H 21/20* (2006.01)

(52) U.S. Cl.
CPC ..... *D21H 17/375* (2013.01); *D21H 17/28* (2013.01); *D21H 21/20* (2013.01)

(58) Field of Classification Search
CPC ..... D21H 17/375; D21H 17/28
See application file for complete search history.

(56) References Cited

FOREIGN PATENT DOCUMENTS

| | | |
|---|---|---|
| AU | 676654 | 3/1997 |
| CN | 103249748 | 8/2013 |
| CN | 104343052 | 2/2015 |
| CN | 105463935 | 4/2016 |

(Continued)

OTHER PUBLICATIONS

Machine translation, JP-2021004425-A (Year: 2021).*

(Continued)

*Primary Examiner* — Catherine S Branch
(74) *Attorney, Agent, or Firm* — JCIPRNET

(57) ABSTRACT

A relatively inexpensive papermaking agent having a high concentration and a high molecular weight that exhibits an excellent freeness and paper strength effect obtained using starches which are biomass materials. A papermaking agent which is a (meth)acrylamide polymer containing starches (a1), a (meth)acrylamide (a2), a polymerizable monomer having an amino group (a3), a polymerizable monomer having a carboxy group (a4) and a polymerizable monomer having a sulfonate group (a5) as essential constituent components, wherein the ratio between the amount of the component (a1) used in terms of non-volatile content weight and a total amount of the components (a2) to (a5) used is [(a1)/{(a2)+(a3)+(a4)+(a5)}]=5/95 to 45/55, and wherein the (meth)acrylamide polymer has a non-volatile content concentration of 22 to 35 weight %, and a weight average molecular weight of 1,500,000 to 7,000,000.

8 Claims, 1 Drawing Sheet

(56) References Cited

FOREIGN PATENT DOCUMENTS

| | | | |
|---|---|---|---|
| CN | 105735039 | | 7/2016 |
| JP | S63219696 | | 9/1988 |
| JP | 2011168948 | | 9/2011 |
| JP | 2012251252 | | 12/2012 |
| JP | 2015113541 | | 6/2015 |
| JP | 2021004425 A | * | 1/2021 |

OTHER PUBLICATIONS

"Office Action of China Counterpart Application", issued on Apr. 30, 2025, with English translation thereof, pp. 1-15.
"Office Action of Taiwan Counterpart Application", issued on Jun. 5, 2025, with English translation thereof, pp. 1-22.

* cited by examiner

PAPERMAKING AGENT, MANUFACTURING METHOD FOR PAPERMAKING AGENT AND PAPER

CROSS-REFERENCE TO RELATED APPLICATION

This application claims the priority benefit of Japan application serial no. 2021-152558, filed on Sep. 17, 2021. The entirety of the above-mentioned patent application is hereby incorporated by reference herein and made a part of this specification.

BACKGROUND

Technical Field

The present invention relates to a papermaking agent, a manufacturing method for a papermaking agent and paper.

Description of Related Art

Papermaking agents are chemicals that are added to a pulp slurry during papermaking, and mainly used for improving the strength and freeness of paper, and the yield of additive chemicals and fine fibers.

Particularly, conventionally, (meth)acrylamide polymers (Patent Documents 1 and 2) and starch are mainly used as papermaking agents for increasing the strength of paper. (Meth)acrylamide polymers have high fixability to pulp, and exhibit an excellent paper strength effect even when added in a small amount but are more expensive than starch. On the other hand, starch is an inexpensive biomass material that can be expected to reduce the amount of carbon dioxide emitted and reduce the environmental load, but has a weaker paper strength effect than (meth)acrylamide polymers, and in order to exhibit the same effect, it is necessary to add a large amount of starch to the pulp non-volatile content.

Thus, by taking advantage of a (meth)acrylamide polymer and starch, these materials have been developed for a method of obtaining a papermaking agent that is relatively inexpensive and has an excellent paper strength effect while using starches which are biomass materials.

As specific examples thereof, papermaking agents obtained by graft polymerization of a monomer mixture including only specified amounts of dialkylaminoalkyl (meth)acrylamide, (meth)acrylic acid and (meth)acrylamide to starch or modified starch are known (Patent Document 3). However, the obtained papermaking agent has a low product concentration. Therefore, the increase in the number of times that papermaking agents having the same non-volatile content weight are transported to the papermaking factory increases the transportation cost, and the amount of fuel consumed during transportation increases, which is undesirable from an environmental point of view, and the paper strength effect is not sufficient. On the other hand, if it is desired to increase the product concentration, since the viscosity is high, it takes time to dilute the papermaking agent with water or the like or it may be difficult to send a liquid with a pump during papermaking. In addition, when it is desired to lower the viscosity while increasing the concentration of the papermaking agent, the weight average molecular weight of the (meth)acrylamide polymer is reduced, and as a result, the polymer does not sufficiently aggregate the pulp, and it is unlikely to be fixed to pulp fibers, which results in a problem of an insufficient paper strength effect.

PATENT DOCUMENTS

[Patent Document 1] Japanese Patent Laid-Open No. 2012-251252

[Patent Document 2] Japanese Patent Laid-Open No. 2011-168948

[Patent Document 3] Japanese Patent Laid-Open No. S63-219696

SUMMARY

The present invention provides a relatively inexpensive papermaking agent having a high concentration and a high molecular weight that exhibits an excellent freeness and paper strength effect obtained using starches which are biomass materials.

The inventors conducted extensive studies regarding an appropriate combination of starches and various monomers and completed the present invention. Specifically, the present invention relates to the following papermaking agent, manufacturing method for a papermaking agent and paper.

1. A papermaking agent which is a (meth)acrylamide polymer containing starches (a1), a (meth)acrylamide (a2), a polymerizable monomer having an amino group (a3), a polymerizable monomer having a carboxy group (a4) and a polymerizable monomer having a sulfonate group (a5) as essential constituent components, wherein the ratio between the amount of the component (a1) used in terms of non-volatile content weight and a total amount of the components (a2) to (a5) used is $[(a1)/\{(a2)+(a3)+(a4)+(a5)\}]=5/95$ to $45/55$, and wherein the (meth)acrylamide polymer has a non-volatile content concentration of 22 to 35 weight %, and a weight average molecular weight of 1,500,000 to 7,000,000.

2. The papermaking agent according to the above 1, wherein, when the total amount of the components (a2) to (a5) used is set as 100 weight %, the amount of the component (a3) is 1.5 to 35 weight %, the amount of the component (a4) is 1 to 15 weight %, and the amount of the component (a5) is 0.5 to 8 weight %.

3. The papermaking agent according to the above 1 or 2, wherein the component (a1) is at least one selected from the group consisting of oxidized starch, cationic starch, amphoteric starch, esterified starch and their degraded starches.

4. The papermaking agent according to any one of the above 1 to 3, wherein the constituent component further includes a polymerizable monomer having a crosslinkable group (a6).

5. The papermaking agent according to any one of the above 1 to 4, wherein the maximum value of the turbidity of an aqueous solution containing 1 weight % of the (meth) acrylamide polymer at a pH of 3 to 9 diluted with water prepared from deionized water and sodium sulfate and having an electrical conductivity of 3 mS/cm at 25° C. is 50 to 1,000 NTU.

6. A method for manufacturing the papermaking agent according to any one of the above 1 to 5, including a process of obtaining a (meth)acrylamide polymer by polymerizing a component (a1), a component (a2), a component (a3), a component (a4) and a component (a5) as essential constituent components in the presence of the component (a1).

7. The method for manufacturing the papermaking agent according to the above 6, wherein the constituent component further includes a polymerizable monomer having a cross-linkable group (a6).

8. Paper including the papermaking agent according to any one of the above 1 to 5.

The papermaking agent of the present invention obtained using starches, which are biomass materials, is relatively inexpensive and has a high concentration and a high weight average molecular weight. In addition, during papermaking, the pulp is sufficiently aggregated, and the (meth)acrylamide polymer contained in the agent is favorably fixed to pulp fibers so that an excellent freeness and paper strength effect is exhibited.

DESCRIPTION OF THE EMBODIMENTS

Figure 1:
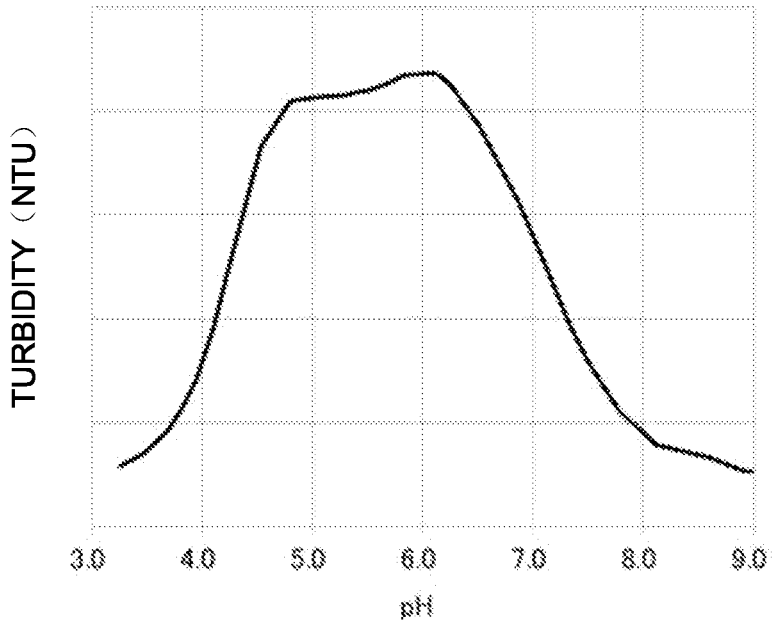
FIG. 1 is a diagram showing a case in which there is "one peak" in the pH-turbidity distribution.

A papermaking agent of the present invention is a (meth) acrylamide polymer containing starches (a1) (hereinafter referred to as a component (a1)), a (meth)acrylamide (a2) (hereinafter referred to as a component (a2)), a polymerizable monomer having an amino group (a3) (hereinafter referred to as a component (a3)), a polymerizable monomer having a carboxy group (a4) (hereinafter referred to as a component (a4)) and a polymerizable monomer having a sulfonate group (a5) (hereinafter referred to as a component (a5)) as essential constituent components.

Hereinafter, the term (meth)acrylamide polymer will be referred to as a polymer containing a component (a1), a component (a2), a component (a3), a component (a4) and a component (a5) as essential constituent components, and particularly a polymer obtained by polymerizing a component (a1), a component (a2), a component (a3), a component (a4) and a component (a5) as essential constituent components in the presence of the component (a1). Here, as the component (a1), a liquid dispersed in a solvent to be described below or a component obtained by heating and gelatinizing a liquid can be used.

Regarding the amounts of the components (a1) to (a5) used, the ratio between the amount of the component (a1) used in terms of non-volatile content weight and a total amount of the components (a2) to (a5) used is [(a1)/{(a2)+(a3)+(a4)+(a5)}]=5/95 to 45/55. When the ratio is less than 5/95, since the amount of the component (a1) used is small, the cost of the (meth)acrylamide polymer increases. In addition, in order to reduce the environmental load, the ratio is preferably 5/95 or more. In addition, when the ratio exceeds 45/55, since the weight average molecular weight of the (meth)acrylamide polymer tends to be low, the (meth) acrylamide polymer is unlikely to be fixed to pulp fibers, and the paper strength effect tends to be poor. In addition, from the same point of view, the ratio is preferably [(a1)/{(a2)+(a3)+(a4)+(a5)}]=5/95 to 40/60 and more preferably [(a1)/{(a2)+(a3)+(a4)+(a5)}]=7.5/92.5 to 35/65.

The component (a1) is starch. When the structure derived from the component (a1) is incorporated into the (meth) acrylamide polymer, the molecular size becomes pseudo-large due to not only the chemical bonds but also physical entanglement, and as a result, the turbidity tends to be improved, and when the obtained papermaking agent is added to a pulp slurry, the pulp is appropriately aggregated due to the (meth)acrylamide polymer contained in the agent, and an excellent paper strength effect is exhibited. The components (a1) are classified into unmodified starch and modified starch. The following unmodified starches and modified starches may be used alone or two or more thereof may be used in combination.

Examples of unmodified starches include corn starch, waxy corn starch, potato starch, tapioca starch, wheat starch, rice starch, and sago starch.

Examples of modified starches include oxidized starch, esterified starch, etherified starch, amidated starch, cationic starch, amphoteric starch, crosslinked starch, and degraded starch.

Examples of oxidized starches include those obtained by treating the unmodified starch with an oxidizing agent. Examples of oxidizing agents include halogens such as chlorine, bromine, hypochlorite, and hypobromite. In addition, examples of salts include alkali metal salts such as potassium and sodium.

Examples of esterified starches include inorganic acid-esterified starches such as nitrate esterified starch, sulfate esterified starch, phosphate-esterified starch, and urea-phosphate-esterified starch; and organic acid-esterified starches such as acetoacetate esterified starch, acetate esterified starch, xanthogen acetate esterified starch, succinate esterified starch, maleic anhydride esterified starch, and fumaric anhydride esterified starch.

Examples of etherified starches include alkyl-etherified starches such as methyl-etherified starch, ethyl-etherified starch, and propyl-etherified starch; hydroxyalkyl-etherified starches such as hydroxymethyl-etherified starch, hydroxyethyl-etherified starch, hydroxypropyl-etherified starch, and hydroxybutyl-etherified starch; carboxymethyl-etherified starch, allyl etherified starch and the like.

Examples of amidated starches include carbamoylethylated starch.

Cationic starch is obtained by treating the unmodified starch with a compound having a cationic group. Examples of compounds having a cationic group include ammonium halides such as 2-diethylaminoethylammonium chloride and 2,3-epoxypropyltrimethylammonium chloride.

Amphoteric starch is obtained by treating the unmodified starch with a compound having a cationic group and a compound having an anionic group, or a compound having both a cationic group and an anionic group, that is, it means a starch having both a cationic group and an anionic group.

Examples of crosslinked starches include phosphate crosslinked starch, acetylated phosphate cross-linked starch, adipic acid cross-linked starch, acetylated adipic acid cross-linked starch, formaldehyde crosslinked starch, acrolein crosslinked starch, and epichlorohydrin crosslinked starch.

Degraded starch is obtained by degrading unmodified starch or modified starch (excluding degraded starch), and is obtained by reacting these starches with a degrading agent and performing heating and stirring at 60 to 100° C. for 30 to 60 minutes.

Examples of degrading agents include hypochlorite, peroxodisulfates (ammonium persulfate, potassium persulfate, sodium persulfate, etc.), and inorganic peroxides such as hydrogen peroxide; bacteria, and enzymes such as α-amylase. These may be used alone or two or more thereof may be used in combination. Here, when hydrogen peroxide is used, at least one water-soluble metal salt of iron sulfate and copper sulfate may be combined.

Examples of commercial products of the component (a1) include "Cornstarch," "Ace A," "Ace P160," and "Ace K100" (commercially available from Oji Cornstarch Co., Ltd.), "Nisshoku MS#4600" (commercially available from Nihon Shokuhin Kako Co., Ltd.), "NutraStar RA-900" (commercially available from Sanwa Cornstarch Co., Ltd.), and "CS-2" (commercially available from Arakawa Chemical Industries, Ltd.). These may be used alone or two or more thereof may be used in combination.

Regarding the component (a1), among these, oxidized starch, cationic starch, amphoteric starch, esterified starch and their degraded starches are preferable, and oxidized starch, cationic starch, amphoteric starch, phosphate-esterified starch, urea-phosphate-esterified starch and their degraded starches are more preferable because the turbidity of the papermaking agent is easily improved, and when added to a pulp slurry, the pulp is appropriately aggregated, and an excellent paper strength effect is exhibited.

Regarding physical properties of the component (a1), the viscosity of the gelatinization liquid of the component (a1) with a non-volatile content concentration of 20 weight % at a temperature of 25° C. is preferably 5 to 5,000 mPa·s and more preferably 10 to 2,500 mPa·s. When the component (a1) having the above viscosity is used, it is likely to react with constituent components such as (meth)acrylamide, the turbidity of the resulting papermaking agent tends to be improved, and when added to a pulp slurry, the pulp is appropriately aggregated due to the (meth)acrylamide polymer contained in the agent, and an excellent paper strength effect is easily exhibited. Here, the gelatinization liquid of the component (a1) with a non-volatile content concentration of 20 weight % is obtained by diluting the component (a1) in a solvent to be described below (particularly, water is preferable) to a non-volatile content concentration of 20 weight % and then performing heating and stirring at a temperature of 90° C. for 1 hour. In addition, the viscosity is a value measured by a B-type viscometer.

The component (a2) is methacrylamide or acrylamide. These may be used alone or two or more thereof may be used in combination.

The component (a3) is a polymerizable monomer having an amino group and is a component that is incorporated into a (meth)acrylamide polymer and allows the polymer to fix pulp fibers favorably. Examples of components (a3) include polymerizable monomers having a secondary amino group, polymerizable monomers having a tertiary amino group, and quaternary salts of these polymerizable monomers.

The polymerizable monomer having a secondary amino group is not particularly limited, and examples thereof include diallylamine. The polymerizable monomer having a tertiary amino group is not particularly limited, and examples thereof include (meth)acrylates having a tertiary amino group such as N,N-dimethylaminoethyl (meth)acrylate and N,N-diethylaminoethyl (meth)acrylate; and (meth) acrylamides having a tertiary amino group such as N,N-dimethylaminopropyl (meth)acrylamide, and N,N-diethylaminopropyl (meth)acrylamide. The quaternary salt of these monomers refers to a product obtained by reacting the polymerizable monomer having a secondary amino group or polymerizable monomer having a tertiary amino group with a quaternary agent, and the quaternary salts may be inorganic acid salts such as hydrochlorides and sulfates or organic acid salts such as acetates. In addition, examples of quaternary agents include methyl chloride, benzyl chloride, dimethyl sulfate, and epichlorohydrin. These may be used alone or two or more thereof may be used in combination. Among these, it is preferable to include a (meth)acrylate having a tertiary amino group and/or a quaternary salt of the (meth)acrylate. Here, "(meth)acrylate" refers to methacrylate or acrylate (the same applies hereinafter).

The component (a4) is a polymerizable monomer having a carboxy group and is a component that is incorporated into a (meth)acrylamide polymer, interacts with aluminum sulfate or the like added to a papermaking system, and allows the polymer to fix pulp fibers. Examples of components (a4) include (meth)acrylic acid, acrylic anhydride, itaconic acid, itaconic anhydride, fumaric acid, maleic acid, and maleic anhydride. Here, these components (a4) may be used as salts such as alkali metal salts such as sodium and potassium, or ammonium salts. These may be used alone or two or more thereof may be used in combination. Among these, it is preferable to include (meth)acrylic acid, itaconic acid, or itaconic anhydride.

The component (a5) is a polymerizable monomer having a sulfonate group. Examples of components (a5) include vinylsulfonic acid, methallylsulfonic acid, and p-styrenesulfonic acid. Here, these components (a5) may be used as salts such as alkali metal salts such as sodium and potassium, or ammonium salts. These may be used alone or two or more thereof may be used in combination.

When the components (a2) to (a5) are used as constituent components, respective non-volatile content weight proportions with respect to 100 weight % of a total amount of the components (a2) to (a5) are as follows.

- Component (a2): the proportion is generally 42 to 97 weight %, and preferably 54 to 94.9 weight %
- Component (a3): the proportion is generally 1.5 to 35 weight %, and preferably 3 to 30 weight %
- Component (a4): the proportion is generally 1 to 15 weight %, and preferably 1.5 to 10 weight %
- Component (a5): the proportion is generally 0.5 to 8 weight %, and preferably 0.6 to 6 weight %

In addition, the constituent components may further include a polymerizable monomer having a crosslinkable group (a6). Examples of components (a6) include N-alkyl (meth)acrylamides such as N-methyl(meth)acrylamide, N-ethyl(meth)acrylamide, and N-isopropyl(meth)acrylamide, N-t-butyl(meth)acrylamide; N,N-dialkyl(meth)acrylamides such as N,N-dimethyl(meth)acrylamide, N,N-diethyl (meth)acrylamide, and N,N-diisopropyl(meth)acrylamide; N,N'-alkylenebis(meth)acrylamides such as N,N'-methylenebis(meth)acrylamide, and N,N'-ethylenebis(meth)acrylamide; crosslinkable monomers having a triallyl group such as triallyl isocyanurate, triallyl trimellitate, triallylamine, and triallyl(meth)acrylamide; and triazines having a (meth)acryloyl group such as 1,3,5-triacryloyl-1,3,5-triazine, and 1,3,5-triacryloylhexahydro-1,3,5-triazine. These may be used alone or two or more thereof may be used in combination. Among these, it is preferable to include N,N-dimethyl(meth) acrylamide, N,N'-methylenebis(meth)acrylamide, or 1,3,5-triacryloylhexahydro-1,3,5-triazine.

Regarding the amounts of the components (a1) to (a6) used when the component (a6) is used as the constituent component, the ratio between the amount of the component (a1) used in terms of non-volatile content weight and a total amount of the components (a2) to (a6) used is generally [(a1)/{(a2)+(a3)+(a4)+(a5)+(a6)}]=5/95 to 45/55, preferably [(a1)/{(a2)+(a3)+(a4)+(a5)+(a6)}]=5/95 to 40/60, and more preferably [(a1)/{(a2)+(a3)+(a4)+(a5)+(a6)}]=7.5/92.5 to 35/65.

The content of the component (a6) with respect to 100 weight % of a total amount of the components (a2) to (a6) is 3 weight % or less, and preferably 2 weight % or less.

The constituent components may further include a monomer (a7) (hereinafter referred to as a component (a7)) other than the components (a2) to (a6). The component (a7) is not particularly limited, and examples thereof include polymerizable monomers having an aromatic ring such as styrene, α-methylstyrene, and vinyl toluene; alkyl(meth)acrylates such as methyl(meth)acrylate, ethyl(meth)acrylate, n-propyl (meth)acrylate, n-butyl(meth)acrylate, 2-ethylhexyl(meth) acrylate, and cyclohexyl(meth)acrylate; vinyl carboxylates such as vinyl acetate and vinyl propionate; nitriles such as acrylonitrile; mercaptans such as 2-mercaptoethanol and n-dodecyl mercaptan; alcohols such as ethanol, isopropyl alcohol, and n-pentyl alcohol; aromatic compounds such as α-methylstyrene dimer, ethylbenzene, isopropylbenzene, and cumene; and carbon tetrachloride. These may be used alone or two or more thereof may be used in combination. In addition, the content of the component (a7) with respect to 100 weight % of a total amount of the components (a2) to (a7) is less than 2 weight %.

In manufacture of (meth)acrylamide polymers, organic acids such as citric acid, succinic acid, and oxalic acid; inorganic acids such as hydrochloric acid, sulfuric acid, and phosphoric acid; inorganic bases such as sodium hydroxide, potassium hydroxide, and calcium hydroxide; and agents such as an antifoaming agent, an antioxidant, a preservative, and an antimicrobial agent may be added. These may be used alone or two or more thereof may be used in combination, and the content thereof with respect to 100 parts by weight of all constituent components is preferably 10 parts by weight or less and more preferably 8 parts by weight or less.

When the amounts of the components (a1) to (a6) used are appropriately adjusted, the (meth)acrylamide polymer of the present invention can have a high concentration and a high weight average molecular weight.

The (meth)acrylamide polymer is obtained by polymerizing the component (a1), the component (a2), the component (a3), the component (a4) and the component (a5) as essential components, and as necessary, the component (a6), the component (a7) and the agent in a solvent in the presence of a polymerization initiator. For example, the manufacturing method includes a process of obtaining a (meth)acrylamide polymer by polymerizing a component (a1), a component (a2), a component (a3), a component (a4) and a component (a5) as essential constituent components in the presence of the component (a1). Here, as the component (a1), a liquid dispersed in a solvent to be described below or a component obtained by heating and gelatinizing a liquid can be used.

Examples of the above polymerization methods include a method using only a dropping polymerization method, a method using only a simultaneous polymerization method (putting mixed monomer solutions together), and a method combining a simultaneous polymerization method and a dropping polymerization method.

Examples of solvents include water and an organic solvent, and these may be used alone or two or more thereof may be used in combination. Examples of organic solvents include alcohols such as methanol, ethanol, n-propyl alcohol, isopropyl alcohol, n-butyl alcohol, sec-butyl alcohol, t-butyl alcohol, isobutyl alcohol, n-hexyl alcohol, n-octyl alcohol, ethylene glycol, propylene glycol, diethylene glycol, triethylene glycol, and diacetone alcohol; and ethers such as ethylene glycol monobutyl ether, propylene glycol monomethyl ether, and propylene glycol monoethyl ether.

Examples of polymerization initiators include persulfates such as ammonium persulfate, potassium persulfate, and sodium persulfate; azo compounds such as 2,2'-azobis(2-amidinopropane)hydrochloride, and 2,2'-azobis[2(2-imidazolin-2-yl)propane]hydrochloride; and hydrogen peroxide. These may be used alone or two or more thereof may be used in combination. Among these, in order for solution polymerization to proceed sufficiently, ammonium persulfate, potassium persulfate, and 2,2'-azobis(2-amidinopropane)hydrochloride are preferable. In addition, a method of adding a polymerization initiator is not particularly limited, and batch addition, divided addition, continuous dropping or the like can be appropriately selected. In addition, the content of the polymerization initiator is not particularly limited, and is generally about 0.001 to 5 parts by weight, and preferably about 0.01 to 1 parts by weight with respect to 100 parts by weight of the components (a2) to (a7).

Regarding polymerization conditions, for example, the reaction temperature is generally 60 to 95° C. (preferably 70 to 90° C.). In addition, the reaction time is, for example, generally 1 to 6 hours (preferably 2 to 4 hours).

Here, the obtained (meth)acrylamide polymer may contain an unreacted component (a1).

Regarding physical properties of the (meth)acrylamide polymer obtained by the above manufacturing method, the non-volatile content concentration is 22 to 35 weight %. If the non-volatile content concentration is less than 22 weight %, since the non-volatile content is small, the transportation cost is high, and if the concentration exceeds 35 weight %, it is difficult to control heat generation by polymerization of the reaction component, and even if a (meth)acrylamide polymer is obtained, when the papermaking agent is added to a pulp slurry, the pulp is not sufficiently aggregated, the polymer is unlikely to be fixed to pulp fibers, and a sufficient paper strength effect is unlikely to be exhibited. In addition, from the same point of view, the non-volatile content concentration is preferably 24 to 32 weight % and more preferably 24.5 to 30 weight %.

The weight average molecular weight of the (meth) acrylamide polymer is 1,500,000 to 7,000,000. If the weight average molecular weight is less than 1,500,000, when the papermaking agent is added to a pulp slurry, the pulp is not sufficiently aggregated due to the (meth)acrylamide polymer contained in the agent, and since the number of cationic groups (for example, amino groups) and anionic groups (for example, carboxy groups and sulfonate groups) in one molecule of the polymer is reduced, it is difficult to fix in the pulp, and a sufficient paper strength effect is unlikely to be exhibited. In addition, if the weight average molecular weight exceeds 7,000,000, a gel is likely to occur in the papermaking agent, and when the papermaking agent is added to a pulp slurry, the pulp causes over-aggregation, the formation breaks, and a paper strength effect is unlikely to be exhibited. In addition, in order or the papermaking agent to exhibit an excellent paper strength effect, the weight average molecular weight is preferably 1,600,000 to 6,500,000 and more preferably 1,800,000 to 6,000,000. Here, the weight average molecular weight is a value obtained by a gel permeation chromatography (GPC) method.

The (meth)acrylamide polymer has a maximum value of 50 to 1,000 NTU of the turbidity at a pH of 3 to 9 in an aqueous solution containing the component (A) having a non-volatile content concentration of 1 weight % dissolved in water prepared from deionized water and sodium sulfate and having an electrical conductivity of 3 mS/cm at 25° C. This numerical value means that, when the papermaking agent is dissolved in a sodium sulfate aqueous solution having an electrical conductivity of 3 mS/cm at 25° C. to prepare an aqueous solution containing the (meth)acrylamide copolymer having a non-volatile content concentration of 1 weight %, the maximum value of the turbidity of the aqueous solution at a pH of 3 to 9 is 50 to 1,000 NTU. If the turbidity satisfies the above numerical value, when the papermaking agent is added to a pulp slurry, the pulp is appropriately aggregated and an excellent paper strength effect is exhibited. In addition, from the same point of view, the turbidity is preferably 60 to 800 NTU and more preferably 80 to 600 NTU.

The turbidity is the degree of turbidity, and is a value obtained by measuring 180-degree scattered light using 900 nm infrared light using ANALITE NEPHELOMETER 152 (commercially available from Mc Van Instruments). The measured value is a relative evaluation value with respect to a standard substance (formazin standard solution 400 NTU, commercially available from Wako Pure Chemical Industries, Ltd.).

Water (aqueous solution) used for turbidity measurement is a sodium sulfate aqueous solution having an electrical conductivity of 3 mS/cm at 25° C. Water used for preparing a sodium sulfate aqueous solution is preferably deionized water. This deionized water is water that has been passed through an ion exchange resin and has an electrical conductivity of 0.2 mS/cm or less. The reason why the above sodium sulfate aqueous solution is used is that, since white water during papermaking contains a large amount of sulfate ions and sodium ions, when sodium sulfate is used, it is possible to create an environment similar to the environment during papermaking, and it is possible to easily increase the electrical conductivity.

Figure 2:
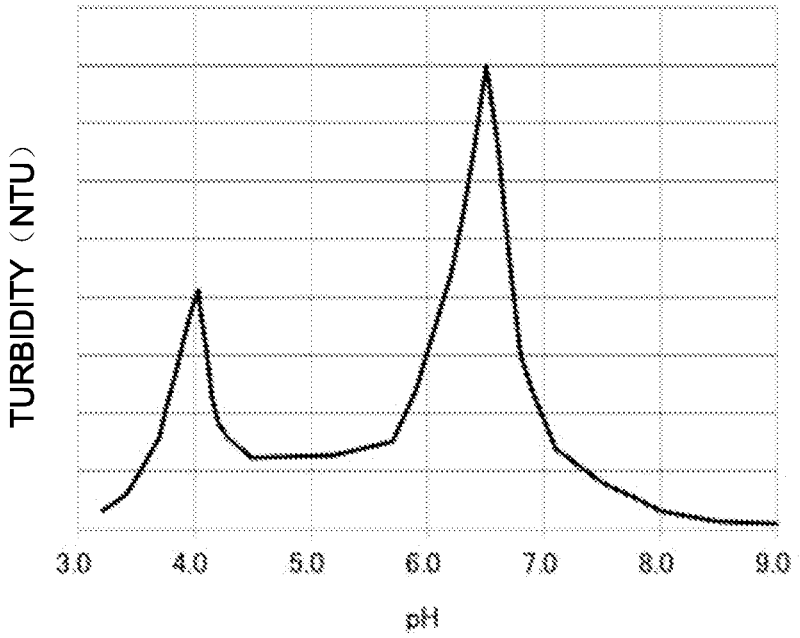
FIG. 2 is a diagram showing a case in which there are "two peaks" in the pH-turbidity distribution.

The turbidity correlates with the degree to which the (meth)acrylamide polymer forms a polyion complex (PIC) and its value varies depending on the pH. Since the (meth) acrylamide polymer has anionic and cationic functional groups in the molecule, it forms a PIC when the pH of the solution approaches the vicinity of the isoelectric point. When the (meth)acrylamide polymer starts to form a PIC, the solution becomes turbid. FIG. 1 is a diagram showing a case in which there is "one peak" in the turbidity distribution. In the turbidity distribution, as shown in FIG. 1, when the pH gradually increases, the turbidity of the solution becomes gradually thicker at first, and the value of the turbidity continues to increase. Thus, after the value reaches the maximum value, the turbidity becomes thinner and the value of the turbidity also decreases (this distribution is called "one peak," refer to FIG. 1). In addition, when an excessive amount of PIC is formed, since the turbidity is thinner due to the formation of precipitates in the solution at a certain point, the value of the turbidity decreases, and when the pH further increases, the turbidity becomes thicken again due to gradual appearance of the precipitate, and the value of the turbidity increases. FIG. 2 is a diagram showing a case in which there are "two peaks" in the turbidity distribution. In this case, as shown in FIG. 2, the turbidity distribution when the pH is changed from 3 to 9, it has two peaks (this distribution is called "two peaks," refer to FIG. 2). In the present invention, in the case of two peaks, if any one peak has a maximum value of 50 to 1,000 NTU, an excellent paper strength effect is exhibited.

In addition, the viscosity of the (meth)acrylamide polymer measured by a B-type viscometer at a temperature of 25° C. is preferably 3,000 to 18,000 mPa·s. If the viscosity is within the above range, when a papermaking agent is added to a pulp slurry, the pulp is sufficiently aggregated due to the (meth)acrylamide polymer contained in the agent, and additionally the polymer is favorably easily fixed to pulp fibers so that an excellent paper strength effect is easily exhibited. In addition, from the same point of view, the viscosity is more preferably 3,500 to 15,000 mPa·s and still more preferably 4,000 to 13,000 mPa·s.

The paper of the present invention contains the above papermaking agent, and for example, the manufacturing method includes addition of a papermaking agent to a raw pulp slurry (hereinafter also referred to as internal addition), spraying it onto the surface of wet paper, or applying it to the surface of the base paper. Here, the papermaking agent is preferably diluted with water and is adjusted so that the non-volatile content concentration is 0.1 to 2 weight %.

In the case of internal addition to a raw pulp slurry, the papermaking agent is added to a pulp slurry to make paper. The amount of the papermaking agent used (in terms of the non-volatile content of the component (A)) is not particularly limited, and is about 0.01 to 4 weight % with respect to the dry weight of the pulp. In addition, the type of the pulp is not particularly limited, and examples thereof include chemical pulp such as hardwood pulp (LBKP) and softwood pulp (NBKP); mechanical pulp such as ground pulp (GP), refiner ground pulp (RGP), and thermomechanical pulp (TMP); and recycled pulp such as waste corrugated fiberboard. Here, when the papermaking agent is internally added, additionally, as fixing agents, pH adjusting agents such as aluminum sulfate, sulfuric acid and sodium hydroxide; papermaking chemicals such as a sizing agent and a wet paper strengthening agent; and fillers such as talc, clay, kaolin, titanium dioxide, and calcium carbonate can be added.

In the case of spraying onto the surface of wet paper, the papermaking agent is sprayed onto the surfaces of one or more layers of wet paper before they are combined and combining is then performed. In this case, the papermaking agent that is diluted so that the non-volatile content concentration is about 0.1 to 7 weight % is used. In addition, the viscosity after dilution is about 2 to 50 mPa·s (a non-volatile content concentration of 1 weight %, 25° C.) at a temperature of 25° C., and generally the used amount thereof (in terms of the non-volatile content) is 0.05 to 10 weight % with respect to the total pulp non-volatile content weight.

In the case of application to the surface of base paper, the papermaking agent is applied to the surface of base paper by various known methods. Here, the papermaking agent applied to the surface of the base paper is referred to as a "coating liquid." The viscosity of the coating liquid is generally 1 to 40 mPa·s at a temperature of 50° C. Regarding the type of base paper, uncoated paper made from wood cellulose fibers as a raw material can be used, and the application method is not particularly limited, and examples thereof include methods using a bar coater, a knife coater, an air knife coater, a calendar, a gate roll coater, a blade coater, a 2-roll size press, rod metering and the like. In addition, the coating amount of the coating liquid (in terms of the non-volatile content) is not particularly limited, and is generally about 0.001 to 2 g/m$^2$, and preferably about 0.005 to 1 g/m$^2$.

The paper of the present invention is used for various products, and examples thereof include coated base paper, newsprint paper, liner, core, paper tube, printing and writing paper, foam paper, PPC paper, cup base paper, inkjet paper, and thermal paper.

EXAMPLES

Hereinafter, the present invention will be described with reference to examples, but the present invention is not limited thereto. Unless otherwise specified, "parts" and "%" in examples and comparative examples are based on weight.

The following compounds are abbreviated.

AM: acrylamide

DM: N,N-dimethylaminoethyl methacrylate

DML: N,N-dimethylaminoethyl methacrylate benzyl chloride

IA: itaconic acid

AA: acrylic acid

SMAS: sodium methallyl sulfonate

DMAA: N,N-dimethylacrylamide

APS: ammonium persulfate

V-50: 2,2'-azobis(2-amidinopropane)hydrochloride

<Viscosity>

1. Component (a1)

Deionized water was added so that the non-volatile content concentration of starches (a1) used as the raw material was 20% and the mixture was then stirred at 90° C. for 1 hour to obtain a gelatinization liquid. The viscosity of the gelatinization liquid adjusted to a temperature of 25° C. was measured using a B-type viscometer (commercially available from Toki Sangyo Co., Ltd.).

2. (Meth)Acrylamide Polymer

The viscosity of the (meth)acrylamide polymer (A) adjusted to a temperature of 25° C. was measured using a B-type viscometer (commercially available from Toki Sangyo Co., Ltd.).

<Weight Average Molecular Weight>

The weight average molecular weight of the (meth) acrylamide polymer (A) was measured by a gel permeation chromatography (GPC) method under the following measurement conditions.

Column: one guard column PWXL and two GMPWXL columns (commercially available from Tosoh Corporation)

Eluent: phosphate buffer solution (0.05 mol/L phosphate (commercially available from FUJIFILM Wako Pure Chemical Corporation)+0.13 mol/L sodium dihydrogen phosphate (commercially available from FUJIFILM Wako Pure Chemical Corporation) aqueous solution, a pH of about 2.5)

Flow rate: 0.8 ml/min

Temperature: 40° C.

RI detector: Shodex RI-101 (commercially available from Showa Denko K.K.)

MALS detector: DAWN HELEOS-II (commercially available from WYATT)

Measurement sample: dilution with the eluent was performed so that the non-volatile content concentration of the (meth)acrylamide polymer (A) was 0.1%, and measurement was performed.

<Turbidity>

Turbidity meter: ANALITE NEPHELOMETER 152 (commercially available from McVan Instruments)

Infrared wavelength: 900 nm

Standard substance: formazin standard solution (400 NTU, commercially available from Wako Pure Chemical Industries, Ltd.)

Sample concentration: 1% (non-volatile content concentration of the (meth)acrylamide polymer (A))

Solvent: water prepared from deionized water and sodium sulfate and having an electrical conductivity of 3 mS/cm at 25° C.

Sample temperature: 25° C.

(Measurement Method)

An aqueous solution obtained by diluting the (meth) acrylamide polymer (A) in the above solvent to a non-volatile content concentration of 1% was stirred with a stirrer at 500 rpm. A 1% sodium hydroxide aqueous solution was used to increase the pH, a 1% sulfuric acid aqueous solution was used to decrease the pH, and these solutions were gradually added dropwise so that the pH changed by 0.1, and the value of the turbidity with respect to the pH was measured. When the turbidity value was not stable, waiting was performed until it became stable, and the numerical value when it became stable was used as the turbidity value. In the turbidity distribution (peak) obtained by the measurement, the maximum value was read. Here, when there were two peaks in the turbidity distribution (peak), a higher value was used as the maximum value. Table 1 shows the maximum value of the turbidity.

Manufacturing Example 1 (Manufacture of Enzyme Modified Amphoteric Starch)

100 parts (non-volatile content) of an amphoteric starch (product name: "Cato3210," commercially available from Ingredion Japan K.K.), 0.02 parts of α-amylase (product name: "Kleistase L1," commercially available from Amano Enzyme Inc.) and 400 parts of deionized water were put into a reaction device including a stirrer, a thermometer, a reflux cooling pipe, a dropping funnel, and a nitrogen gas introduction pipe, and the mixture was heated to 75° C. and stirred for 40 minutes and then heated to 90° C. and additionally stirred for 1 hour to obtain an enzyme modified amphoteric starch having a non-volatile content concentration of 20% and a viscosity of 1,100 mPa·s (25° C.).

Manufacturing Example 2 (Manufacture of Enzyme Modified Cationic Starch)

100 parts (non-volatile content) of cationic starch (product name: "CS-2," commercially available from Arakawa Chemical Industries, Ltd.), 0.02 parts of α-amylase (product name: "Kleistase L1," commercially available from Amano Enzyme Inc.), and 36.6 parts of deionized water were put into the same reaction device as in Manufacturing Example 1, the mixture was heated to 75° C. and stirred for 40 minutes and then heated to 90° C. and additionally stirred for 1 hour to obtain an enzyme modified cationic starch having a non-volatile content concentration of 20% and a viscosity of 120 mPa·s (25° C.).

Example 1

100 parts (non-volatile content) of an oxidized starch (product name: "Ace A," commercially available from Oji Cornstarch Co., Ltd.) and 400 parts of deionized water were put into a reaction device including a stirrer, a thermometer, a reflux cooling pipe, a dropping funnel, and a nitrogen gas introduction pipe, nitrogen gas was directly blown thereinto, oxygen in the liquid was removed and stirring was then performed while the temperature was raised to 80° C. 644 parts (non-volatile content: 322 parts) of a 50% AM aqueous solution, 40 parts of DM, 33.3 parts (non-volatile content 20 parts) of 60% DML, 12 parts of IA, 6 parts of SMAS, 19.6 parts (non-volatile content: 12.3 parts) of a 62.5% sulfuric acid aqueous solution and 245.1 parts of deionized water were put into a dropping funnel (1), and the pH was adjusted to 3.0 with sulfuric acid. In addition, 0.8 parts of APS and 180 parts of deionized water were put into a dropping funnel (2). Next, dropwise addition was performed into the starch aqueous solution over 3 hours from the dropping funnels (1) and (2). After dropwise addition was completed, 0.8 parts of APS and 10 parts of deionized water were added and reacted until the viscosity shown in Table 1 was reached. The sample was diluted with deionized water so that the non-volatile content concentration was 25% to obtain a (meth)acrylamide polymer (A-1). Table 1 shows the viscosity, the weight average molecular weight, and the maximum value of the turbidity (the same applies hereinafter).

Examples 2, 5 to 11, and 15 to 24 and Comparative Examples 3 and 4

Using the compositions and used amounts shown in Table 1, the same method as in Example 1 was performed to obtain (meth)acrylamide polymers (A-2), (A-5) to (A-11), (A-15) to (A-24), (B-3), and (B-4) having a non-volatile content concentration of 25%. Here, in Example 16, the oxidized starch and urea-phosphate-esterified starch were added so that the non-volatile content weight ratio between the oxidized starch and the urea-phosphate-esterified starch was 50/50.

Example 3

150 parts (non-volatile content) of an oxidized starch (product name: "Ace A," commercially available from Oji Cornstarch Co., Ltd.) and 586 parts of deionized water were put into the same reaction device as in Example 1, nitrogen gas was directly blown thereinto, oxygen in the liquid was removed and stiffing was then performed while the temperature was raised to 80° C. 563.4 parts (non-volatile content: 281.7 parts) of a 50% AM aqueous solution, 35 parts of DM, 29.2 parts (non-volatile content: 17.5 parts) of 60% DML, 10.5 parts of IA, 5.3 parts of SMAS, 17.1 parts of a 62.5% sulfuric acid aqueous solution (non-volatile content: 10.7 parts) and 183.8 parts of deionized water were put into a dropping funnel (1), and the pH was adjusted to 3.0 with sulfuric acid. In addition, 0.8 parts of APS and 60 parts of deionized water were put into a dropping funnel (2). Next, dropwise addition was performed into the starch aqueous solution over 3 hours from the dropping funnels (1) and (2). After dropwise addition was completed, 0.8 parts of APS and 10 parts of deionized water were added and reacted until the viscosity shown in Table 1 was reached. The sample was diluted with deionized water so that the non-volatile content concentration was 25% to obtain a (meth)acrylamide polymer (A-3).

Example 4

200 parts (non-volatile content) of an oxidized starch (product name: "Ace A," commercially available from Oji Cornstarch Co., Ltd.) and 689.4 parts of deionized water were put into the same reaction device as in Example 1, nitrogen gas was directly blown thereinto, oxygen in the liquid was removed and stiffing was then performed while the temperature was raised to 80° C. 483 parts (non-volatile content: 241.5 parts) of a 50% AM aqueous solution, 30 parts of DM, 25 parts (non-volatile content: 15 parts) of 60% DML, 9 parts of IA, 4.5 parts of SMAS, 14.7 parts (non-volatile content: 9.2 parts) of a 62.5% sulfuric acid aqueous solution and 183.8 parts of deionized water were put into a dropping funnel (1), and the pH was adjusted to 3.0 with sulfuric acid. In addition, 0.8 parts of APS and 60 parts of deionized water were put into a dropping funnel (2). Next, dropwise addition was performed into the starch aqueous solution over 3 hours from the dropping funnels (1) and (2). After dropwise addition was completed, 0.8 parts of APS and 10 parts of deionized water were added and reacted until the viscosity shown in Table 1 was reached. The sample was diluted with deionized water so that the non-volatile content concentration was 25% to obtain a (meth)acrylamide polymer (A-4).

Example 12

100 parts (non-volatile content) of an oxidized starch (product name: "Ace A," commercially available from Oji Cornstarch Co., Ltd.) and 367.8 parts of deionized water were put into the same reaction device as in Example 1, nitrogen gas was directly blown thereinto, oxygen in the liquid was removed and stiffing was then performed while the temperature was raised to 80° C. 632.0 parts (non-volatile content: 316 parts) of a 50% AM aqueous solution, 40 parts of DM, 33.3 parts (non-volatile content 20 parts) of 60% DML, 12 parts of IA, 12 parts of SMAS, 19.6 parts (non-volatile content: 12.3 parts) of a 62.5% sulfuric acid aqueous solution and 251.1 parts of deionized water were put into a dropping funnel (1), and the pH was adjusted to 3.0 with sulfuric acid. In addition, 0.8 parts of APS and 60 parts of deionized water were put into a dropping funnel (2). Next, dropwise addition was performed into the starch aqueous solution over 3 hours from the dropping funnels (1) and (2). After dropwise addition was completed, 0.8 parts of APS and 10 parts of deionized water were added and reacted until the viscosity shown in Table 1 was reached. The sample was diluted with deionized water so that the non-volatile content concentration was 32% to obtain a (meth)acrylamide polymer (A-12).

Example 13

500 parts (non-volatile content: 100 parts) of the enzyme modified amphoteric starch of Manufacturing Example 1 and 10 parts of deionized water were put into the same reaction device as in Example 1, nitrogen gas was directly blown thereinto, oxygen in the liquid was removed and stiffing was then performed while the temperature was raised to 80° C. Then, the process was performed in the same manner as in Example 1 to obtain a (meth)acrylamide polymer (A-13).

Example 14

The enzyme modified cationic starch of Manufacturing Example 2 was used in place of the enzyme modified amphoteric starch of Manufacturing Example 1 in Example 13 to obtain a (meth)acrylamide polymer (A-14).

Comparative Example 1

250 parts (non-volatile content) of an oxidized starch (product name: "Ace A," commercially available from Oji Cornstarch Co., Ltd.) and 877 parts of deionized water were put into the same reaction device as in Example 1, nitrogen gas was directly blown thereinto, oxygen in the liquid was removed and stiffing was then performed while the temperature was raised to 80° C. 402.4 parts (non-volatile content: 201.2 parts) of a 50% AM aqueous solution, 25 parts of DM, 20.8 parts (non-volatile content 12.5 parts) of 60% DML, 7.5 parts of IA, 3.8 parts of SMAS, 12.2 parts (non-volatile content: 7.6 parts) of a 62.5% sulfuric acid aqueous solution and 153.2 parts of deionized water were put into a dropping funnel (1), and the pH was adjusted to 3.0 with sulfuric acid. In addition, 0.8 parts of APS and 60 parts of deionized water were put into a dropping funnel (2). Next, dropwise addition was performed into the starch aqueous solution over 3 hours from the dropping funnels (1) and (2). After dropwise addition was completed, 0.8 parts of APS and 10 parts of deionized water were added and reacted until the viscosity shown in Table 1 was reached. The sample was diluted with deionized water so that the non-volatile content concentration was 25% to obtain a (meth)acrylamide polymer (B-1).

Comparative Example 2

Using the compositions and used amounts shown in Table 1, the same method as in Comparative Example 1 was performed to obtain a (meth)acrylamide polymer (B-2) having a non-volatile content concentration of 25%.

Comparative Example 5

100 parts (non-volatile content) of an oxidized starch (product name: "Ace A," commercially available from Oji Cornstarch Co., Ltd.) and 430.8 parts of deionized water were put into a reaction device including a stirrer, a thermometer, a reflux cooling pipe, and a nitrogen gas introduction pipe, nitrogen gas was directly blown thereinto, oxygen in the liquid was removed, and stirring was then performed while the temperature was raised to 90° C. After stirring at 90° C. for 1 hour, cooling was performed to 40° C., 624 parts (non-volatile content: 312 parts) of a 50% AM aqueous solution, 40 parts of DM, 33.3 parts (non-volatile content: 20 parts) of 60% DML, 12 parts of IA, 16 parts of SMAS, and 19.6 parts of a 62.5% sulfuric acid aqueous solution (non-volatile content: 12.3 parts) were added and the pH was adjusted to 3.0 with sulfuric acid. 0.4 parts of V-50 and 10 parts of deionized water were put into the reaction device, and after heat generation according to polymerization heat was confirmed, the reaction was performed while cooling the reaction device. After the temperature reached to the maximum temperature, stirring was performed for 30 minutes, 0.8 parts of APS and 10 parts of deionized water were added, and the reaction was performed until the viscosity shown in Table 1 was reached. The sample was diluted with deionized water so that the non-volatile content concentration was 38% to obtain a (meth)acrylamide polymer (B-5).

TABLE 1

| | (Meth)acrylamide polymer | | | | | | | | | | | | | |
|---|---|---|---|---|---|---|---|---|---|---|---|---|---|---|
| | Composition | | | | | | | | | Physical properties | | | | |
| | | Monomer (weight %) | | | | | | | Starches/ monomers (weight | | Concen- | Vis- | Weight average molecular | Maxi- mum value of turbidity |
| | Starches | AM | DM | DML | IA | AA | SMAS | DMAA | ratio) | Sym- bol | tration (%) | cosity (mPa · s) | weight (10000) | (NTU) |
| Example 1 | Oxidized starch | 80.5 | 10.0 | 5.0 | 3.0 | — | 1.5 | — | 2/8 | A-1 | 25 | 8800 | 330 | 110 |
| Example 2 | Oxidized starch | 80.5 | 10.0 | 5.0 | 3.0 | — | 1.5 | — | 1/9 | A-2 | 25 | 9600 | 340 | 80 |
| Example 3 | Oxidized starch | 80.5 | 10.0 | 5.0 | 3.0 | — | 1.5 | — | 3/7 | A-3 | 25 | 9100 | 250 | 130 |
| Example 4 | Oxidized starch | 80.5 | 10.0 | 5.0 | 3.0 | — | 1.5 | — | 4/6 | A-4 | 25 | 9800 | 180 | 150 |
| Example 5 | Oxidized starch | 80.5 | 10.0 | 5.0 | 3.0 | — | 1.5 | — | 2/8 | A-5 | 25 | 3500 | 240 | 90 |
| Example 6 | Oxidized starch | 80.5 | 10.0 | 5.0 | 3.0 | — | 1.5 | — | 2/8 | A-6 | 25 | 16200 | 410 | 130 |
| Example 7 | Oxidized starch | 81.2 | 10.0 | 5.0 | 3.0 | — | 0.8 | — | 2/8 | A-7 | 25 | 9400 | 290 | 100 |
| Example 8 | Oxidized starch | 78.0 | 10.0 | 5.0 | 3.0 | — | 4.0 | — | 2/8 | A-8 | 25 | 8500 | 510 | 130 |
| Example 9 | Oxidized starch | 74.5 | 10.0 | 5.0 | 3.0 | — | 6.0 | 1.5 | 2/8 | A-9 | 25 | 8700 | 620 | 140 |
| Example 10 | Oxidized starch | 80.0 | 10.0 | 5.0 | 3.0 | — | 1.5 | 0.5 | 2/8 | A-10 | 25 | 9200 | 360 | 120 |
| Example 11 | Oxidized starch | 80.0 | 10.0 | 5.0 | 3.0 | — | 2.0 | — | 2/8 | A-11 | 28 | 11200 | 280 | 105 |
| Example 12 | Oxidized starch | 79.0 | 10.0 | 5.0 | 3.0 | — | 3.0 | — | 2/8 | A-12 | 32 | 12800 | 230 | 100 |
| Example 13 | Enzyme modified amphoteric starch | 80.5 | 10.0 | 5.0 | 3.0 | — | 1.5 | — | 2/8 | A-13 | 25 | 9100 | 330 | 140 |
| Example 14 | Enzyme modified cationic starch | 80.5 | 10.0 | 5.0 | 3.0 | — | 1.5 | — | 2/8 | A-14 | 25 | 9000 | 310 | 110 |
| Example 15 | Urea-phosphate-esterified starch | 80.5 | 10.0 | 5.0 | 3.0 | — | 1.5 | — | 2/8 | A-15 | 25 | 8200 | 340 | 150 |
| Example 16 | Oxidized starch/Urea-phosphate-esterified starch | 80.5 | 10.0 | 5.0 | 3.0 | — | 1.5 | — | 2/8 | A-16 | 25 | 8500 | 340 | 140 |
| Example 17 | Oxidized starch | 77.5 | 10.0 | 5.0 | — | 6.0 | 1.5 | — | 2/8 | A-17 | 25 | 9500 | 360 | 80 |
| Example 18 | Oxidized starch | 70.5 | 20.0 | 5.0 | 3.0 | — | 1.5 | — | 2/8 | A-18 | 25 | 9200 | 310 | 450 |
| Example 19 | Oxidized starch | 75.5 | 5.0 | 15.0 | 3.0 | — | 1.5 | — | 2/8 | A-19 | 25 | 9800 | 320 | 420 |
| Example 20 | Oxidized starch | 73.5 | 10.0 | 5.0 | 10.0 | — | 1.5 | — | 2/8 | A-20 | 25 | 8800 | 280 | 290 |
| Example 21 | Oxidized starch | 64.0 | 20.0 | 5.0 | 10.0 | — | 1.0 | — | 2/8 | A-21 | 25 | 9100 | 230 | 380 |
| Example 22 | Oxidized starch | 50.3 | 25.0 | 10.0 | 14.0 | — | 0.7 | — | 2/8 | A-22 | 25 | 8300 | 180 | 850 |
| Example 23 | Oxidized starch | 92.5 | 3.0 | 1.0 | 1.5 | — | 2.0 | — | 2/8 | A-23 | 25 | 9600 | 350 | 70 |
| Example 24 | Oxidized starch | 96.3 | 0.5 | 0.5 | 0.5 | — | 2.2 | — | 2/8 | A-24 | 25 | 9800 | 360 | 45 |
| Comparative Example 1 | Oxidized starch | 80.5 | 10.0 | 5.0 | 3.0 | — | 1.5 | — | 5/5 | B-1 | 25 | 9400 | 110 | 180 |
| Comparative Example 2 | Oxidized starch | 76.5 | 10.0 | 5.0 | 3.0 | — | 4.0 | 1.5 | 5/5 | B-2 | 25 | 9000 | 140 | 200 |

TABLE 1-continued

| | (Meth)acrylamide polymer | | | | | | | | | | | | | |
|---|---|---|---|---|---|---|---|---|---|---|---|---|---|---|
| | Composition | | | | | | | | | Physical properties | | | | |
| | Starches | Monomer (weight %) AM | DM | DML | IA | AA | SMAS | DMAA | Starches/monomers (weight ratio) | Symbol | Concentration (%) | Viscosity (mPa · s) | Weight average molecular weight (10000) | Maximum value of turbidity (NTU) |
| Comparative Example 3 | Oxidized starch | 80.5 | 10.0 | 5.0 | 3.0 | — | 1.5 | — | 2/8 | B-3 | 25 | 1200 | 120 | 70 |
| Comparative Example 4 | Oxidized starch | 81.6 | 10.0 | 5.0 | 3.0 | — | 0.4 | — | 2/8 | B-4 | 25 | 8700 | 130 | 60 |
| Comparative Example 5 | Oxidized starch | 78.0 | 10.0 | 5.0 | 3.0 | — | 4.0 | — | 2/8 | B-5 | 38 | 11500 | 180 | 90 |

Component (a1)

Oxidized starch: product name "Ace A," commercially available from Oji Cornstarch Co., Ltd., a viscosity of 400 mPa·s (a non-volatile content concentration of 20% and a temperature of 25° C.)

Enzyme modified amphoteric starch: refer to Manufacturing Example 1.

Enzyme modified cationic starch: refer to Manufacturing Example 2.

Urea-phosphate-esterified starch: product name "Ace P160," commercially available from Oji Cornstarch Co., Ltd., viscosity of 40 mPa·s (a non-volatile content concentration of 20% and a temperature of 25° C.)

<Papermaking Evaluation>

Evaluation Examples 1 to 24 and Comparative Evaluation Examples 1 to 5

The (meth)acrylamide polymer (A) of the examples and the comparative example were used as papermaking agents without change, and deionized water was added and the sample was diluted so that the non-volatile content concentration was 1.0%. Then, the following papermaking evaluation was performed.

Corrugated cardboard waste paper was beaten with a Niagara beater, calcium chloride was added to a pulp slurry adjusted to 350 ml of Canadian standard freeness (C. S. F), and the electrical conductivity was adjusted to 3.0 mS/cm. After 0.5% of the non-volatile content of aluminum sulfate with respect to the non-volatile content weight of the pulp slurry was added to this slurry liquid, each papermaking agent was added in an amount at which the non-volatile content was 0.5% with respect to the non-volatile content weight of the pulp slurry. The pH of each pulp slurry was adjusted to 6.5. The sample was dehydrated with a tappi sheet machine and pressed at 5 kg/cm$^2$ for 2 minutes to make paper so that the basis weight was 150 g/m$^2$. Next, the sample was dried with a rotary dryer at 105° C. for 4 minutes, and the humidity was controlled for 24 hours under conditions of a temperature of 23° C. and a humidity of 50% to obtain Paper 1. Here, papermaking was performed in the same method without adding the papermaking agent to obtain Paper 2. The amount of drainage, formation, burst strength and fixation rate of Paper 1 were measured by the following methods. The results are shown in Table 2.

<Amount of Drainage>

The amount of drainage was measured using Canadian standard freeness (C. S. F) according to JIS P 8121.

<Formation (Formation Variation Coefficient)>

Light (luminance) passing through the paper obtained above was incorporated into a commercially available measuring instrument (product name "Personal Image Processing System Hyper-700," commercially available from OBS), and the value obtained by statistically analyzing the luminance distribution was defined as a formation variation coefficient. A smaller value of the formation variation coefficient indicates better formation.

<Specific Burst Strength>

The specific burst strength (kPa·m$^2$/g) was measured using the paper obtained above according to JIS P 8131.

TABLE 2

| | Symbol | Drainage (mL) | Formation variation coefficient (%) | Specific burst strength (kPa · m$^2$/g) |
|---|---|---|---|---|
| Evaluation Example 1 | A-1 | 446 | 26.0 | 3.47 |
| Evaluation Example 2 | A-2 | 430 | 25.1 | 3.41 |
| Evaluation Example 3 | A-3 | 430 | 25.6 | 3.40 |
| Evaluation Example 4 | A-4 | 410 | 25.3 | 3.31 |
| Evaluation Example 5 | A-5 | 418 | 25.2 | 3.36 |
| Evaluation Example 6 | A-6 | 468 | 27.3 | 3.55 |
| Evaluation Example 7 | A-7 | 433 | 25.3 | 3.42 |
| Evaluation Example 8 | A-8 | 481 | 28.0 | 3.55 |
| Evaluation Example 9 | A-9 | 492 | 28.5 | 3.46 |
| Evaluation Example 10 | A-10 | 456 | 26.6 | 3.46 |
| Evaluation Example 11 | A-11 | 434 | 25.3 | 3.42 |
| Evaluation Example 12 | A-12 | 421 | 25.3 | 3.37 |
| Evaluation Example 13 | A-13 | 459 | 26.8 | 3.52 |
| Evaluation Example 14 | A-14 | 442 | 25.8 | 3.46 |
| Evaluation Example 15 | A-15 | 465 | 27.1 | 3.54 |
| Evaluation Example 16 | A-16 | 461 | 26.9 | 3.53 |
| Evaluation Example 17 | A-17 | 433 | 25.3 | 3.42 |
| Evaluation Example 18 | A-18 | 528 | 30.8 | 3.47 |
| Evaluation Example 19 | A-19 | 525 | 30.6 | 3.47 |
| Evaluation Example 20 | A-20 | 493 | 28.8 | 3.35 |
| Evaluation Example 21 | A-21 | 498 | 29.0 | 3.37 |
| Evaluation Example 22 | A-22 | 534 | 31.1 | 3.30 |
| Evaluation Example 23 | A-23 | 424 | 26.3 | 3.39 |
| Evaluation Example 24 | A-24 | 408 | 25.2 | 3.25 |
| Comparative Evaluation Example 1 | B-1 | 370 | 24.9 | 3.06 |
| Comparative Evaluation Example 2 | B-2 | 388 | 25.1 | 3.09 |
| Comparative Evaluation Example 3 | B-3 | 356 | 24.9 | 3.07 |

TABLE 2-continued

| | Symbol | Drainage (mL) | Formation variation coefficient (%) | Specific burst strength (kPa · $m^2$/g) |
|---|---|---|---|---|
| Comparative Evaluation Example 4 | B-4 | 363 | 25.0 | 3.05 |
| Comparative Evaluation Example 5 | B-5 | 378 | 25.2 | 3.10 |

What is claimed is:

1. A papermaking agent, comprising:

water; and a (meth)acrylamide polymer containing at least one starch (a1), a (meth)acrylamide (a2), a polymerizable monomer having an amino group (a3), a polymerizable monomer having a carboxy group (a4) and a polymerizable monomer having a sulfonate group (a5) as essential constituent components, wherein a ratio between an amount of the component (a1) used in terms of non-volatile content weight and a total amount of the components (a2) to (a5) used is [(a1)/{(a2)+(a3)+(a4)+(a5)}]=5/95 to 45/55, and wherein the papermaking agent has a non-volatile content concentration of 22 to 35 weight %, and wherein the (meth)acrylamide polymer has a weight average molecular weight of 1,500,000 to 7,000,000.

2. The papermaking agent according to claim 1, wherein, when the total amount of the components (a2) to (a5) used is set as 100 weight %, an amount of the component (a3) is 1.5 to 35 weight %, an amount of the component (a4) is 1 to 15 weight %, and an amount of the component (a5) is 0.5 to 8 weight %.

3. The papermaking agent according to claim 1, wherein the component (a1) is at least one selected from the group consisting of oxidized starch, cationic starch, amphoteric starch, esterified starch and their degraded starches.

4. The papermaking agent according to claim 1, wherein the constituent component further includes a polymerizable monomer having a crosslinkable group (a6).

5. The papermaking agent according to claim 1, wherein a maximum value of a turbidity of an aqueous solution containing 1 weight % of the (meth)acrylamide polymer at a pH of 3 to 9 diluted with water prepared from deionized water and sodium sulfate and having an electrical conductivity of 3 mS/cm at 25° C. is 50 to 1,000 NTU.

6. A method for manufacturing the papermaking agent according to claim 1, comprising a process of obtaining the (meth)acrylamide polymer by polymerizing the component (a1), the component (a2), the component (a3), the component (a4) and the component (a5) as essential constituent components in the presence of the component (a1).

7. The method for manufacturing the papermaking agent according to claim 6, wherein the constituent component further includes a polymerizable monomer having a crosslinkable group (a6).

8. Paper comprising the papermaking agent according to claim 1.

* * * * *